US008911126B2

(12) United States Patent
Lai

(10) Patent No.: US 8,911,126 B2
(45) Date of Patent: Dec. 16, 2014

(54) VEHICLE LAMP SYSTEM

(71) Applicant: Hon Hai Precision Industry Co., Ltd., New Taipei (TW)

(72) Inventor: Chih-Chen Lai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/941,301

(22) Filed: Jul. 12, 2013

(65) Prior Publication Data

US 2014/0313754 A1 Oct. 23, 2014

(51) Int. Cl.
*F21V 11/00* (2006.01)
*F21S 8/10* (2006.01)

(52) U.S. Cl.
CPC ..... *F21S 48/1388* (2013.01)
USPC ..... 362/510; 362/511

(58) Field of Classification Search
USPC ..... 362/510, 554, 311.01, 551, 307, 293, 362/511
See application file for complete search history.

(56) References Cited

U.S. PATENT DOCUMENTS

2013/0027964 A1 * 1/2013 Toyota et al. ..... 362/554

* cited by examiner

*Primary Examiner* — Anne Hines
(74) *Attorney, Agent, or Firm* — Novak Druce Connolly Bove + Quigg LLP

(57) ABSTRACT

A vehicle lamp system includes a laser source, a reflecting mirror, a light converting element and a reflecting plate. The reflecting mirror is located at a position towards a light emitting direction of the laser source. Light generated from the laser source is reflected to the light converting element by the reflecting mirror. The light converting element includes a base and diffusing particles cooperating with the base. The light transmitted from the reflecting mirror is diffused via the light converting element. The reflecting plate reflects the light transmitted from the light converting element out of a vehicle.

10 Claims, 4 Drawing Sheets

VEHICLE LAMP SYSTEM

BACKGROUND

1. Technical Field

The disclosure relates to an illumination system, and particularly to a vehicle lamp system with an enhanced light utilizing efficiency.

2. Description of Related Art

A conventional vehicle lamp apparatus used in a vehicle provides illumination by a halogen bulb cooperating with a parabolic reflecting mirror. However, the vehicle lamp apparatus using the halogen bulb as the light source has many shortcomings, such as poor light distributions, low light utilizing efficiency, etc.

What is needed, therefore, is a vehicle lamp system which can overcome the shortcoming as described above.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
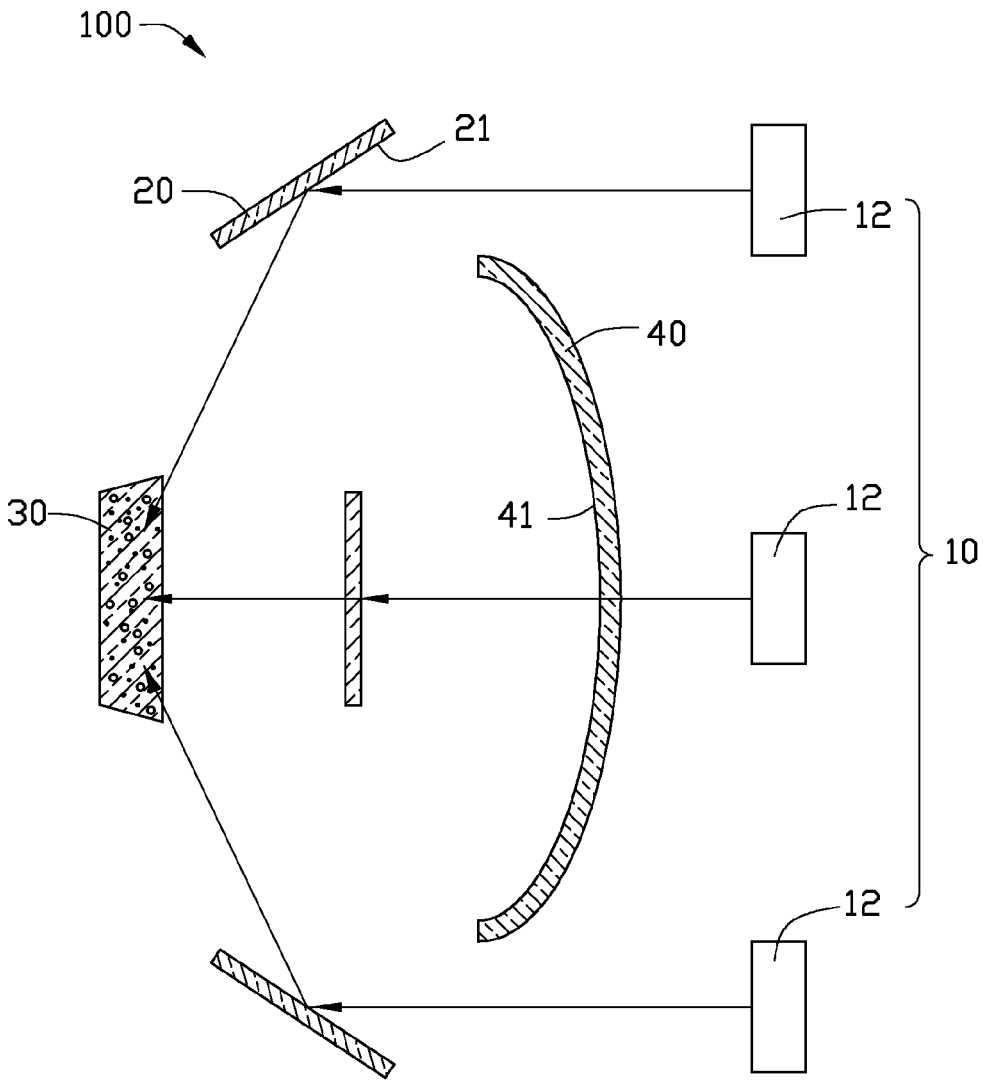
FIG. 1 is a schematic view of a vehicle lamp system in accordance with a first embodiment of the disclosure.

Referring to FIG. 1, a vehicle lamp system 100 in accordance with a first embodiment of the disclosure is shown. The vehicle lamp system 100 includes a laser source 10, a plurality of reflecting mirrors 20, a light converting element 30 and a reflecting plate 40. FIG. 1 just schematically shows the construction of the vehicle lamp system 100. The laser source 10, the reflecting mirrors 20, the light converting element 30 and the reflecting plate 40 are not distributed in a same plane.

The laser source 10 includes a plurality of laser diodes 12. The laser diodes 12 are electrically connected to a storage battery in a vehicle to obtain electrical power from the storage battery. In this embodiment, the laser diodes 12 irradiate blue light when work.

The reflecting mirrors 20 face a light emitting direction of the laser source 10. Light generated from the laser source 10 is reflected to the light converting element 30 by the reflecting mirrors 20. The number of the reflecting mirrors 20 is equal to the number of the laser diodes 12. Each of the reflecting mirrors 20 is corresponding to one of the laser diodes 12. Each of the reflecting mirrors 20 is a flat plate, and has a planar reflecting face 21. Each laser diode 12 irradiates light on the reflecting face 21 of a corresponding one of the reflecting mirrors 20. The reflecting faces 21 of the reflecting mirrors 20 reflect the light to the light converting element 30.

Figure 2:
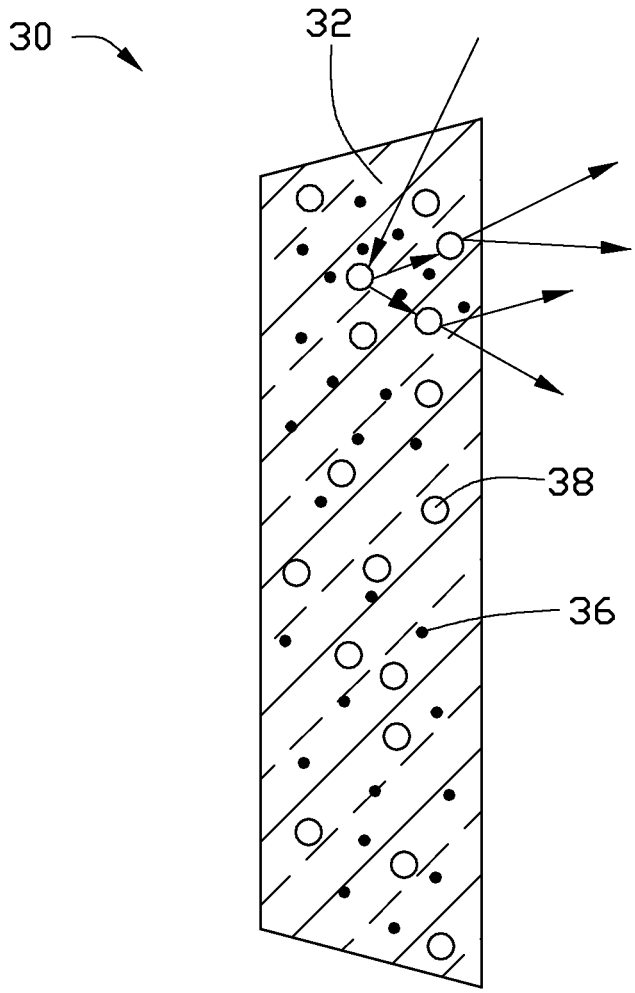
FIG. 2 is an enlarged view of a light converting element of the vehicle lamp system of FIG. 1.
Figure 3:
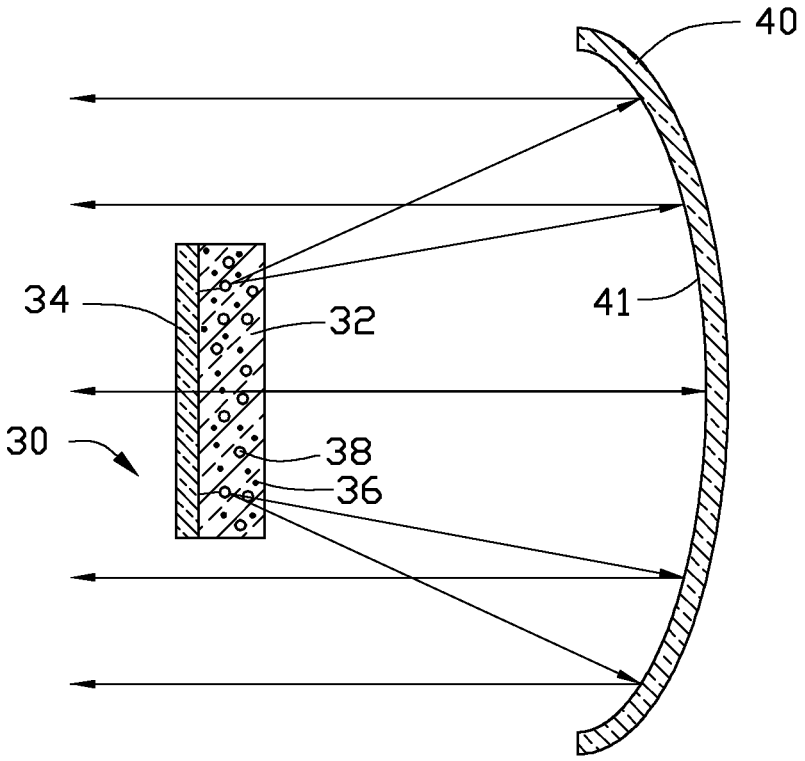
FIG. 3 is a schematic view of a light converting element and a reflecting plate of the vehicle lamp system of FIG. 1 which are seen from another aspect.

Referring to FIGS. 2-3, the light converting element 30 includes a transparent base 32, a reflecting layer 34, phosphor powders 36, and diffusing grains 38. Compared to the transparent base 32, the reflecting layer 34 is farther from the reflecting mirrors 20. In this embodiment, the phosphor powders 36 and the diffusing grains 38 are contained in an interior of the base 32. The base 32 is made of optical grade resin or silica gel. The diffusing grains 38 can be made of high transparent organic resin. The shape of each of the diffusing grains 38 can be spheric, aspheric, or cubic.

The light reflected to the light converting element 30 firstly enters into the base 32 of the light converting element 30, and then is reflected to the reflecting plate 40 by the reflecting layer 34 of the light converting element 30. During the light transmitting in the base 32, the light is diffused by the diffusing grains 38, thereby forming a surface light source with the light evenly distributed in a large illumination area. The phosphor powders 36 change color of the light transmitted from the reflecting mirrors 20. In this embodiment, the phosphor powders 36 convert the light transmitted from the reflecting mirrors 20 into white light.

The reflecting plate 40 reflects the light transmitted from the light converting element 30 out of the vehicle. The reflecting plate 40 is arc-shaped and has a concave reflecting face 41. The reflecting face 41 faces a light emitting direction of the light converting element 30.

According to the disclosure, the vehicle lamp system 100 uses the laser diodes 12 as the light source. The light emitted from the laser diodes 12 is transmitted to the reflecting mirrors 20, the light converting element 30 and the reflecting plate 40 in sequence, thereby converting the point type light sources formed by the laser diodes 12 into the surface type light source with the light evenly distributed and a large illumination area. Thus, the light utilizing efficiency of the light generated from the laser diodes 12 is greatly enhanced.

Figure 4:
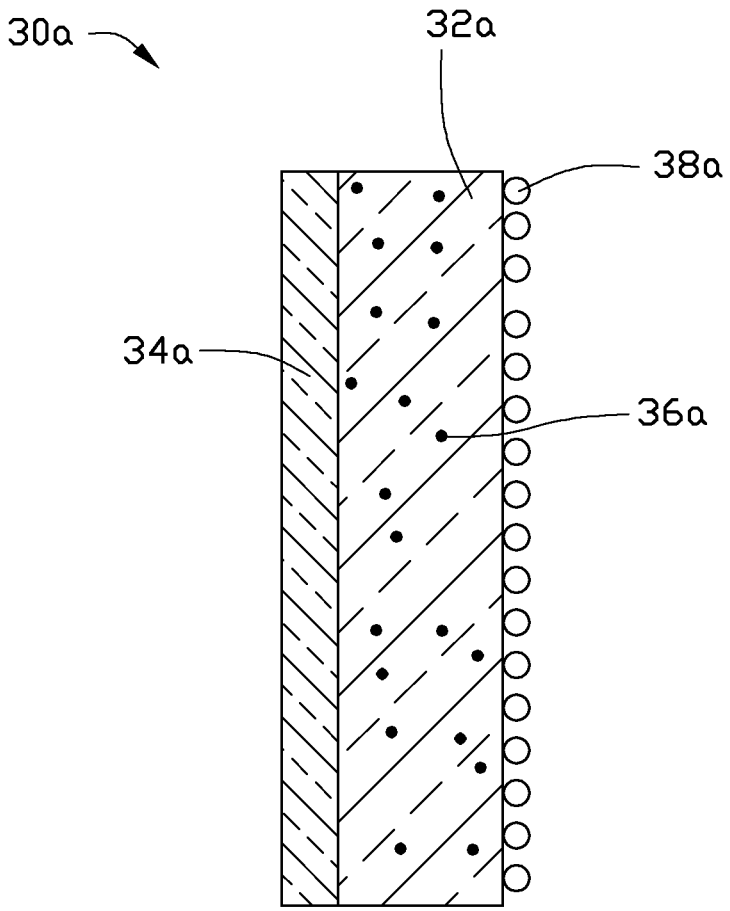
FIG. 4 is a schematic view of a light converting element of a vehicle lamp system in accordance with a second embodiment of the disclosure.

Referring to FIG. 4, a light converting element 30*a* of a vehicle lamp system in accordance with a second embodiment of the present disclosure is shown. The light converting element 30*a* includes a transparent base 32*a*, a reflecting layer 34*a*, phosphor powders 36*a*, and diffusing grains 38*a*. The phosphor powders 36*a* are contained in an interior of the base 32*a*. The base 32*a* is made of optical grade resin or silica gel. The diffusing grains 38*a* can be made of high transparent organic resin. The shape of the diffusing grains 38*a* can be spheric, aspheric, or cubic. In the second embodiment, the diffusing grains 38*a* are formed on an outer face of the base 32*a* away from the reflecting layer 34*a* by means of spraying technique or coating.

It is believed that the disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A vehicle lamp system, comprising:

a laser source;

at least one reflecting mirror facing a light emitting direction of the laser source;

a light converting element, wherein the at least one reflecting mirror is positioned to reflect light generated from the laser source to the light converting element, the light converting element comprises a transparent base and diffusing particles cooperating with the transparent base, the plurality of diffusing particles being configured for diffusing light transmitted to the light converting element; and a reflecting plate positioned to reflect light from the light converting element out of the vehicle lamp system;

wherein the laser source comprises a plurality of laser diodes, the at least one reflecting mirror comprising a plurality of reflecting mirrors, the number of the reflecting mirrors being equal to the number of the laser diodes, each of the plurality of reflecting mirrors being positioned to corresponding to each of the plurality of laser diodes.

2. The vehicle lamp system of claim 1, wherein each of the reflecting mirrors is a flat plate and has a planar reflecting face, each of the reflecting mirrors is positioned such that each of the laser diodes irradiates light onto the reflecting face of each of the reflecting mirrors, and the reflecting face reflects light to the light converting element.

3. The vehicle lamp system of claim 1, wherein the light converting element further comprises a reflecting layer, the reflecting layer being remote from the reflecting mirrors relative to the transparent base, and the reflecting layer of the light converting element reflects light to the reflecting plate.

4. The vehicle lamp system of claim 3, wherein the light converting element further comprises phosphor powders, the phosphor powders and the diffusing particles being contained in an interior of the base.

5. The vehicle lamp system of claim 3, wherein the diffusing particles are distributed on an outer face of the base, away from the reflecting layer, by means of spraying or coating.

6. The vehicle lamp system of claim 3, wherein the reflecting plate is arc-shaped and defines a concave reflecting face, and the concave reflecting face facing a light emitting direction of the light converting element.

7. The vehicle lamp system of claim 1, wherein the light converting element further comprises a reflecting layer, light reflected to the light converting element enters into the base of the light converting element, and then being reflected to the reflecting plate by the reflecting layer.

8. The vehicle lamp system of claim 1, wherein a material of the diffusing particles is transparent organic resin.

9. The vehicle lamp system of claim 1, wherein the base is made of optical grade resin or silica gel.

10. The vehicle lamp system of claim 1, wherein a shape of each of the diffusing particles is spheric, aspheric, or cubic.

* * * * *